United States Patent [19]

Guarascio

[11] 4,271,010

[45] Jun. 2, 1981

[54] CYLINDRICAL SEPARATOR APPARATUS FOR SEPARATING MIXTURES OF SOLIDS OF DIFFERENT SPECIFIC GRAVITIES, PARTICULARLY FOR THE MINING INDUSTRY

[76] Inventor: Massimo Guarascio, Via Urbana 12/C, Rome, Italy

[21] Appl. No.: 939,684

[22] Filed: Sep. 5, 1978

[30] Foreign Application Priority Data

Sep. 6, 1977 [IT] Italy ..... 27291 A/77

[51] Int. Cl.[3] ..... B04C 3/04

[52] U.S. Cl. ..... 209/211; 210/512.2

[58] Field of Search ..... 209/211, 144; 210/512 R, 512 M; 55/261

[56] References Cited

U.S. PATENT DOCUMENTS

| | | | |
|---|---|---|---|
| 2,757,582 | 8/1956 | Freeman et al. | 209/211 |
| 3,219,186 | 11/1965 | Polhemus et al. | 209/211 X |
| 3,358,844 | 12/1967 | Klein et al. | 55/261 X |
| 3,477,569 | 11/1969 | Klein et al. | 209/144 |
| 3,740,929 | 6/1973 | Gordon et al. | 55/261 |
| 3,917,568 | 11/1975 | Klein et al. | 55/261 X |

FOREIGN PATENT DOCUMENTS

| | | | |
|---|---|---|---|
| 2747192 | 4/1978 | Fed. Rep. of Germany | 209/211 |

*Primary Examiner*—Ralph J. Hill

*Attorney, Agent, or Firm*—Diller, Ramik & Wight

[57] ABSTRACT

This invention relates to a cylindrical separator apparatus for separating mixtures of solids of different specific gravities, particularly for the mining industry. The apparatus according to the invention is formed by a hollow cylindrical body, which is divided by a partition wall into two consecutive chambers communicating with each other through an axial pipe provided in the partition wall. An axial inlet pipe and an axial outlet pipe are provided in the front walls of said chambers opposite to the partition wall. Tangential inlet pipes and tangential outlet pipes are further provided in the vicinity of the partition wall and of the respective front walls of said chamber.

12 Claims, 3 Drawing Figures

CYLINDRICAL SEPARATOR APPARATUS FOR SEPARATING MIXTURES OF SOLIDS OF DIFFERENT SPECIFIC GRAVITIES, PARTICULARLY FOR THE MINING INDUSTRY

For the separation of mixtures of solids of different specific gravities, particularly of mineral particles, there are known separator devices which utilize a dense medium or fluid constituted by a suspension in water of finely ground heavy materials, such as ferrosilicon or magnetite, which dense fluid provides a centrifugal field inside a chamber.

The separators known and used in industry of that kind are of two types:

(a) the cylindrical-conical separator, where the particles to be separated together with the dense fluid are introduced tangentially into the cylindrical portion, the heavy fraction of the particles together with a part of the dense fluid leaves from the lower outlet at the apex of the conical portion and the light fraction of the particles together with the remaining part of the dense fluid leaves from an upper outlet constituted by a socalled "vortex-seeker;"

(b) the cylindrical separator, sometimes called "dyna-whirlpool", where the particles to be separated are introduced axially at one end of the cylindrical chamber together with a small part of the dense fluid and the remaining prevailing part of the dense fluid is introduced tangentially at the opposite end of the chamber. The heavy fraction of the particles together with a part of the dense fluid is delivered in this case tangentially at the end of the chamber where the particles to be separated are introduced, while the light fraction of the particles is delivered axially together with the remaining part of the dense fluid at the end of the chamber where the tangential introduction of the prevailing part of the dense fluid takes place.

An inconvenience common with those types of separators lies in the fact that they do not allow a very accurate separation in the case in which the particles to be separated contain an amount of heavy particles variable in time and particularly when this amount of heavy particles besides being variable also is elevated.

As a matter of fact, considering the first type of separator with cylindrical-conical chamber, the periodical variation of the amount of heavy particles to be delivered at the lower outlet or at the apex of the conical portion of the chamber determines a variation of the flow resistance of the slurry as if the diameter of said outlet were periodically restricted or widened depending on the larger or smaller amount of heavy particles. This periodical variation determines a variation of the thickening of the suspension inside the separator chamber which in turn cuases a periodical variation of the density of separation. Apparently, in that way there are not granted stable conditions of separation and the accuracy of the separation itself results to be considerably diminished.

To make the above clearer it should be borne in mind that by the expression "density of separation" it is intended to indicate the value of density of the dense fluid (suspension) at which there takes place the desired optimal separation of light and heavy particles.

Considering the other type of separator with cylindrical chamber, the inconvenience mentioned above equally occurs, though to a somewhat smaller extent.

This is due to the fact that in this apparatus the fraction of heavy particles is delivered through a pipe of great diameter as compared with the apex of the cylindrical-conical chamber, and the adjustment of the flow is obtained by effect of a counter-pressure created by means of a rubber pipe at adjustable height instead of by throttling the apex of the cylindrical-conical chamber.

The inconvenience described, while it may raise no particular problems with easy ores, acquires greater importance when treating difficult ores, i.e. ores having a higher percentage of mixed particles or even of ores with small difference of specific gravities of the components to be separated.

In those cases indeed it is necessary that the density of separation be very stable, if it is wanted to attain an acceptable effectiveness of separation.

Hence it is an object of the present invention to provide a cylindrical separator device that allows to attain a high stability of the density of separation and, therefore, a high accuracy and effectiveness of separation, and this to a large extent independently of the variable percentage of heavy particles contained in the mixture to be subjected to separation and of the difference of specific gravities of the particles to be separated.

This object is attained according to the instant invention by a cylindrical separator apparatus characterized in that it is constituted by a hollow cylindrical body that is divided by a baffle into two consecutive chambers communicating with each other through an axial pipe provided in said baffle or partition, in the front wall of the first chamber opposite said partition there being provided an axial inlet pipe and in the front wall of the second chamber opposite the partition there being provided an axial outlet pipe, the first chamber being moreover provided with a tangential inlet pipe in the proximity of the partition and with a tangential outlet pipe in the proximity of its front wall, and the second chamber being moreover provided with a tangential inlet pipe in the proximity of its front wall and with a tangential outlet pipe in the proximity of the partition.

The separator apparatus according to the invention can be operated in different ways according to whether in the two chambers there are provided equal or different densities of separation. In the former case, the separation carried out in the second chamber is an improvement of the separation carried out in the first chamber, whilst in the latter case the apparatus carries out a separation in two cuts with production of three products: a rich product, a mixed product and a waste or tail.

The features and advantages of the invention are set forth more in detail hereinafter referring to the appended drawings which diagrammatically represent the separator apparatus in an embodiment given by way of example. In the drawings.

Figure 1:
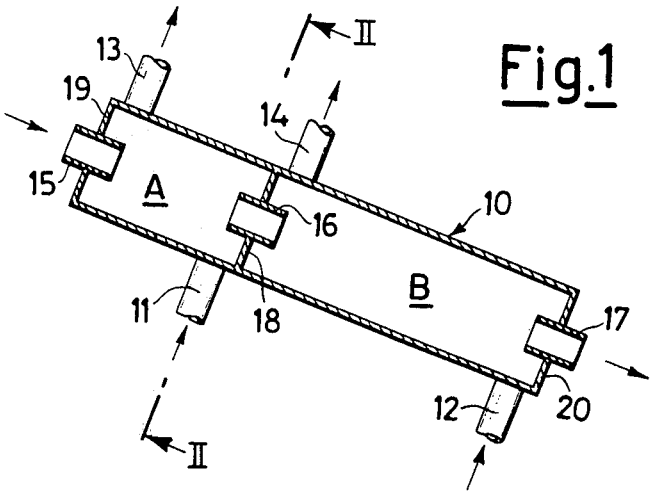
FIG. 1 shows a longitudinal axial section of the apparatus.

As seen in FIG. 1, the separator apparatus according to the invention is constituted essentially by a hollow cylindrical body, indicated as a whole by reference numeral 10. A partition wall 18 divides the interior of the cylindrical body 10 into two chambers A and B which in the case shown have different dimensions, the chamber A being shorter than the chamber B. The two chambers may even have equal dimensions.

The cylindrical body 10 may be arranged slanting, as in the drawing, or horizontally.

In the front wall 19 of the first chamber A there is provided an axial inlet pipe 15 and in the front wall 20 of the second chamber B there is provided an axial outlet pipe 17.

In the proximity of the partition 18 there opens tangentially into the first chamber A an inlet pipe 11 and still in the proximity of said partition 18 there departs tangentially from the second chamber B an outlet pipe 14.

Moreover, in the vicinity of the front wall 19 there departs tangentially from the first chamber A an outlet pipe 13 and in the vicinity of the front wall 20 there opens tangentially into the second chamber B an inlet pipe 12.

Figure 2:
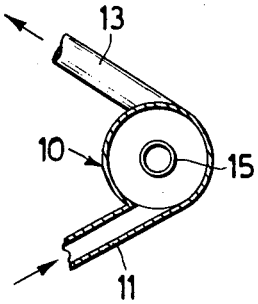
FIG. 2 is a cross-section along the line II—II of FIG. 1.
Figure 3:
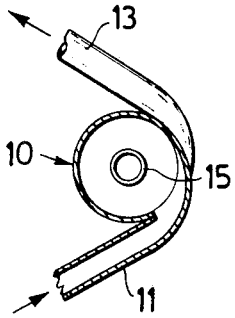
FIG. 3 is a cross-section analogous to that of FIG. 2, showing a variant of embodiment.

The pipes 11, 12, 13 and 14 may be cylindrical pipes fitted tangentially into the cylindrical body 10, as shown in FIG. 2, or these pipes may be constituted by rectangular conduits jointed with the wall of the cylindrical body 10 by means of a volute, as shown in FIG. 3.

The ore to be treated is fed to the chamber A of the device through the axial inlet pipe 15. The dense fluid (suspension) is fed separately to the two chambers A and B through the tangential inlet pipes 11 and 12. The heavy fraction separated in each chamber is unloaded through the tangential outlet pipes 13 and 14 respectively. Finally the final light fraction, i.e., the waste, if the useful ore is contained in the heavy fraction, is unloaded from the apparatus through the axial outlet pipe 17 departing from the second chamber B.

Through an axial pipe 16 provided in the partition 18 and putting the two chambers A and B in communication with each other, the light fraction separated in the chamber A passes from chamber A over to chamber B together with a part of the dense fluid.

It is evident that the condition of pressures in the two chambers A and B should be such as to allow that passage through the pipe 16 from chamber A into chamber B.

As said, the separator apparatus according to the invention can be operated in different ways.

In a first way of operation, in the two chambers A and B there are provided equal or nearly equal densities of separation by modifying conveniently the values of the specific gravities of the dense fluids fed respectively through the pipes 11 and 12 into the chambers A and B.

In this case the separation attained in the chamber B is an improvement of the separation attained in the chamber A, that is to say, the first chamber A carries out so to say a roughing and the second chamber B instead carries out so to say a finishing. The two heavy fractions recovered at the outlets 13 and 14 may be put together to form the concentrates (dressed ore) (if the heavy fraction containes the useful ore), the largest part of the heavy ore being unloaded through the outlet pipe 13 of the first pipe A. Only a small amount of residual heavy grains is delivered through the connecting pipe 16 into the second chamber B, in which then there is carried out a separation in conditions of great stability and the light fraction unloaded through the axial pipe 17 has substantially no more heavy grain left and its content of useful component is very small. The overall yield therefore is high. Essentially the first chamber has the function of absorbing the oscillations of the content of heavy fraction in the feed, and since owing to those oscillations the separation carried out in the first chamber cannot be very accurate, the second chamber B improves that separation delivering finally at the outlet 17 a very poor waste.

In the second way of operation of the separator apparatus there are provided in the two chambers A and B different densities of separation, namely in chamber B a density of separation lower than that in chamber A. In this case, the apparatus carries out a separation in two cuts with the production of three products: a first concentrate at the outlet 13, a second mixed product at the outlet 14 (this product may be recycled or it may be subjected to other treatments), and finally a waste at the outlet 17.

This latter type of treatment can be useful in many cases, for instance for the oxydized antimony ores: the first concentrate is ready to be sent to metallurgical treatment; the mixed product can be treated by means of shaking tables after having been ground to yield a richer concentrate and the waste results to be very poor whence the overall recovery of metal obtained results to be much higher than with other processes.

The separator apparatus according to the invention has been described and illustrated by way of example without limitation and it will be understood that it may undergo numerous modifications within the scope of the invention. Moreover it will be self-evident that with the apparatus according to the invention there are applicable all technical ingenuities known per se by the skilled in the art though not specified in the present specification.

I claim:

1. A cylindrical separator apparatus for the separation of mixtures of solids of different specific gravities, particularly for the mining industry, comprising a hollow cylindrical body that is divided by a partition wall into two consecutive first and second respective uppermost and lowermost chambers communicating with each other through an axial pipe provided in said partition wall, a front wall of said first chamber opposite to said partition wall being provided with an axial inlet pipe and a front wall of the second chamber opposite to the partition wall being provided with an axial outlet pipe, the first chamber being moreover provided with a tangential inlet pipe in the vicinity of the partition wall and with a tangential outlet pipe in the vicinity of its front wall, and the second chamber, being moreover provided with a tangential inlet pipe in the vicinity of its front wall and with a tangential outlet pipe in the vicinity of the partition wall.

2. A separator apparatus according to claim 1 wherein said partition wall divides the interior of the cylindrical body into two chambers of unequal dimensions, the first chamber being shorter than the second chamber.

3. A separator apparatus according to claim 1 wherein the tangential pipes are fitted to the wall of the cylindrical body by means of volutes.

4. A separator apparatus as defined in claim 1 wherein said first chamber inlet pipe is positioned immediately adjacent said partition wall and said second chamber inlet pipe is positioned immediately adjacent the second chamber front wall.

5. A separator apparatus as defined in claim 4 wherein said first and second chamber inlet pipes are each positioned in a plane disposed generally normal to a coincident axis of said first and second chambers.

6. A separator apparatus as defined in claim 4 wherein said cylindrical body includes an axis disposed at an acute angle to the horizontal.

7. A separator apparatus as defined in claim 1 wherein said cylindrical body includes an axis disposed at an acute angle to the horizontal.

8. The separator apparatus as defined in claim 1 wherein said first and second chamber inlet pipes are each positioned in a plane disposed generally normal to a coincident axis of said first and second chambers.

9. A separator apparatus as defined in claim 8 wherein said cylindrical body includes an axis disposed at an acute angle to the horizontal.

10. A separator apparatus as defined in claim 9 wherein said first chamber inlet pipe is positioned immediately adjacent said partition wall and said second chamber inlet pipe is positioned immediately adjacent the second chamber front wall.

11. A separator apparatus according to claim 10 wherein the tangential pipes are fitted to the wall of the cylindrical body by means of volutes.

12. A separator apparatus according to claim 9 wherein the tangential pipes are fitted to the wall of the cylindrical body by means of volutes.

* * * * *